US005802656A

United States Patent [19]

Dawson et al.

[11] Patent Number: 5,802,656

[45] Date of Patent: Sep. 8, 1998

[54] TOOTHBRUSH WITH FLEXIBLY MOUNTED BRISTLES

[75] Inventors: Peter Leonard Dawson, Upton by Chester, United Kingdom; Bert Davis Heinzelman, Tenafly, N.J.; Donald Richard Lamond, Lynbrook; John Moldauer, Brooklyn, both of N.Y.; Stephen John Raven, Milan, Italy

[73] Assignee: Chesebrough-Pond's USA Co., Division of Conopco, Inc., Greenwich, Conn.

[21] Appl. No.: 757,365

[22] Filed: Nov. 27, 1996

[30] Foreign Application Priority Data

Dec. 1, 1995 [GB] United Kingdom ..... 9524580

[51] Int. Cl.[6] ..... A46B 9/04

[52] U.S. Cl. ..... 15/110; 15/167.1; 15/201

[58] Field of Search ..... 15/110, 167.1, 15/201

[56] References Cited

U.S. PATENT DOCUMENTS

| | | | |
|---|---|---|---|
| 1,323,042 | 11/1919 | Gardner | 15/167.1 |
| 1,770,195 | 7/1930 | Burlew | 15/167.1 |
| 2,139,245 | 12/1938 | Ogden | 15/110 X |
| 2,253,210 | 8/1941 | Psiharis | 15/167.1 X |
| 2,706,825 | 4/1955 | Blakeman | 15/167.1 X |
| 2,807,820 | 10/1957 | Dinhofer | 15/167.1 X |
| 2,819,482 | 1/1958 | Applegate | 15/167.1 X |
| 3,553,759 | 1/1971 | Kramer et al. | 15/110 |
| 4,472,853 | 9/1984 | Rauch | 15/167.1 |
| 4,776,054 | 10/1988 | Rauch | 15/167.1 |
| 5,373,602 | 12/1994 | Bang | 15/167.1 |

FOREIGN PATENT DOCUMENTS

| | | | |
|---|---|---|---|
| 520692 | 1/1956 | Canada | 15/167.1 |
| 0 613 636 | 9/1994 | European Pat. Off. . | |
| 88562 | 2/1967 | France | 15/167.1 |
| 438091 | 11/1935 | United Kingdom | 15/110 |
| WO 92/17092 | 10/1992 | WIPO . | |
| WO 92/17093 | 10/1992 | WIPO . | |
| WO 92/17094 | 10/1992 | WIPO . | |
| 94/05183 | 3/1994 | WIPO . | |
| 95/30350 | 11/1995 | WIPO . | |
| 97/07707 | 3/1997 | WIPO . | |
| 97/14330 | 4/1997 | WIPO . | |

*Primary Examiner*—Mark Spisich
*Attorney, Agent, or Firm*—Milton L. Honig

[57] ABSTRACT

A toothbrush is provided having a handle and a bristle bearing head. The head includes a central skeleton, resilient side members mounted on either side of the central skeleton, tuft mounting receptacles in both the skeleton and the side members, and bristle forming tufts received in both the tuft mounting receptacles of the skeleton and of the side members. The side member bristle tufts are movable both sideways and downwards in a toggling movement relative to the bristle tufts stationarily mounted on the skeleton.

16 Claims, 10 Drawing Sheets

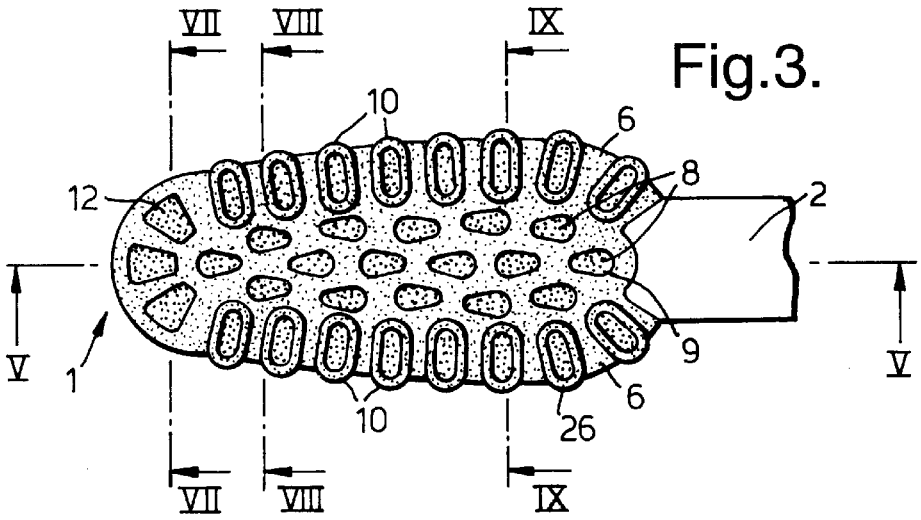
Fig.3.
Fig.4.
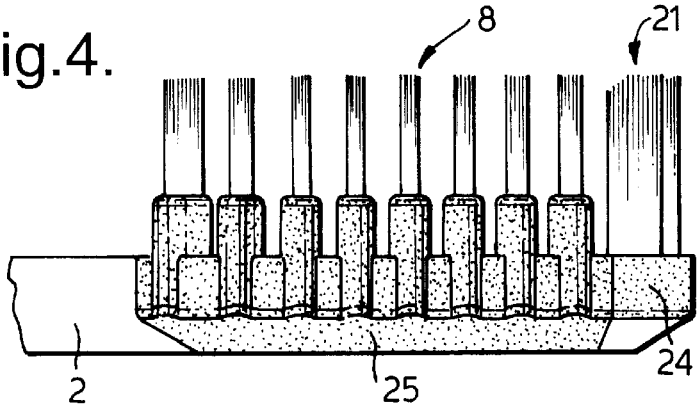
Fig.5.
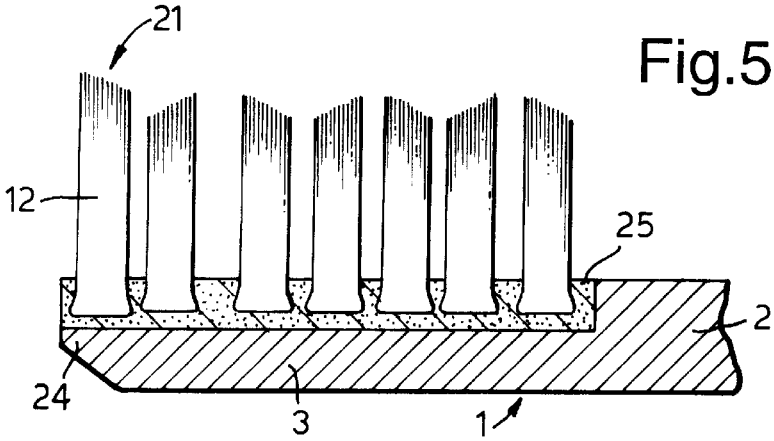

TOOTHBRUSH WITH FLEXIBLY MOUNTED BRISTLES

BACKGROUND OF THE INVENTION

Field of the Invention

The invention relates to a toothbrush having flexibly mounted bristles on the toothbrush head.

The Related Art

Plaque forms on the teeth of all animals and causes microbial related diseases to both the teeth (caries) and their supporting tissues (periodontal disease). In contrast to other members of the animal kingdom, man has developed means of controlling the amount of plaque on the teeth. When used properly, the toothbrush can be an effective tool for removing plaque. However most individuals do not brush effectively, and disease-causing quantities of plaque remain on the teeth. The toothbrush remains the best potential method for achieving satisfactory plaque control and many designs of brushes have been suggested.

Although the aim of toothbrushing is to remove plaque, excessive force or brushing frequency can lead to damage of the teeth or the soft tissues. To remove plaque effectively toothbrush filaments need to penetrate into the "V" shaped interproximal areas between the teeth to remove plaque with a minimum amount of force.

Conventional toothbrushes comprise bristles mounted in rigid head materials. The rigid head material provides support for the bristles.

The bristles are generally mounted on the toothbrush in a substantially upward orientation. Following use over a prolonged period the bristles tend to splay permanently outwards from the upward orientation whereupon the toothbrush is discarded and replaced.

However, it has been found that an improved cleaning operation can be performed with a toothbrush in which the bristles are flexed/splayed or adapted to splay in a controllable and repeatable manner. Accordingly, toothbrushes have been developed in which the toothbrush head is flexible to facilitate movement of the bristles in use. The flexible head is usually made up of jointed portions or segments which facilitate articulation of groups of bristles. Generally, the tufts can only flex in one direction/plane only i.e. parallel to the plane defined by the longitudinal axis of the handle transverse to said plane. However, a disadvantage of such segments is that unwanted foreign matter can accumulate in spaces between the segments and that individual tufts cannot articulate independently of one another thereby reducing cleaning and plaque removal efficacy.

Bristles, particularly fine bristles, produce a more effective cleaning effect when they penetrate into the interproximal spaces between the teeth and gums. However, it has been found that fine bristle tufts are particularly susceptible to excessive permanent splaying in use thereby reducing cleaning efficacy. Accordingly, rapid deterioration of the toothbrush results.

An object of the invention is to provide a toothbrush having a head with bristles mounted therein in which the bristles mounted on the toothbrush head can repeatably and resiliently splay and move in a multidirectional manner i.e. the bristle tufts move in all planes (upwards/downwards/sideways) hereinafter referred to as "toggle".

SUMMARY OF THE INVENTION

According to the invention there is provided a toothbrush having a handle at one end thereof and a bristle bearing head characterised in that the head comprises resilient mechanism, the bristles being mounted in the resilient mechanism, said resilient mechanism supporting independent bristle movement.

More particularly, the invention provides a toothbrush having a handle and a bristle bearing head characterised in that the head comprises a central skeleton, a resilient side member mounted either side of the central skeleton, tuft mounting member in the skeleton and/or the side member for receiving bristles, the side member bristle tufts being capable of a toggling movement.

Suitably, the skeleton comprises a material having a modulus of elasticity which is higher than the modulus of elasticity of the resilient side member. The side member tuft mounting mechanism comprises an array of rigid receptacles or wells attached to the skeleton.

Advantageously, the receptacles or wells are substantially surrounded by the resilient side members.

Preferably, the side member tuft mounting means further comprises a bridge hinge intermediate the well and the skeleton and the bridge hinge comprises a material having a flow index of at least 25. Suitably, the bristle tufts are mounted in the skeleton and the side members mounting mechanism.

More preferably the skeleton is ellipsoidal. Suitably, the skeleton is substantially surrounded by the side members. More suitably, the side members further comprise at least one massaging protrusion.

Advantageously the resilient mechanism further comprises a resilient boot surrounding the bristles or tufts of bristles. Preferably the resilient mechanism and the boots are integral to form a unitary resilient mechanism and the resilient block and the boots comprise a rubber material.

Alternatively the central skeleton further comprises a frame which surrounds the resilient block.

Preferably the tufts of bristles comprise tear-shaped tufts.

Advantageously the skeleton comprises a material selected from the group comprising polypropylene and nylon while the side member bristle tufts comprise fine bristles.

BRIEF DESCRIPTION OF THE DRAWING

The invention will now be described having regard to the accompanying drawing in which:

FIG. 3 is a top plan view of the first embodiment of a toothbrush head of the invention in which the peripheral arrays of bristles are booted;

FIG. 4 is a side elevation of the toothbrush head;

FIG. 5 is a cross sectional view along the line V—V of FIG. 3;

DETAILED DESCRIPTION OF THE INVENTION

Figure 1:
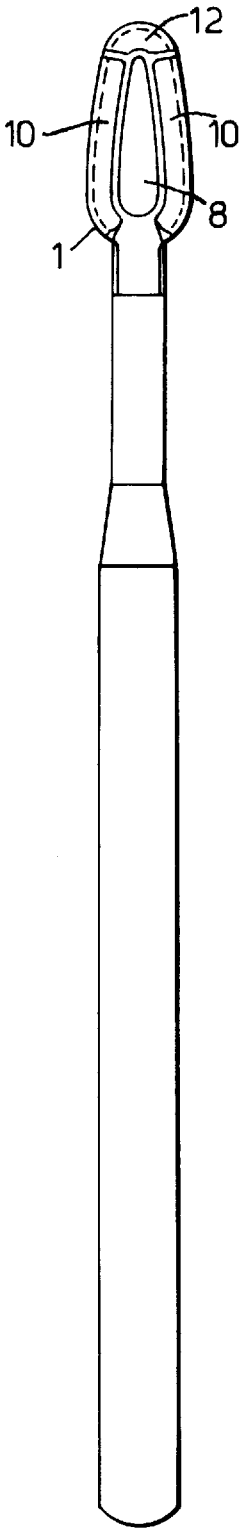
FIG. 1 is a top plan view of a first embodiment of a toothbrush of the invention showing the handle and toothbrush head with the bristles shown in broken lines.
Figure 2:
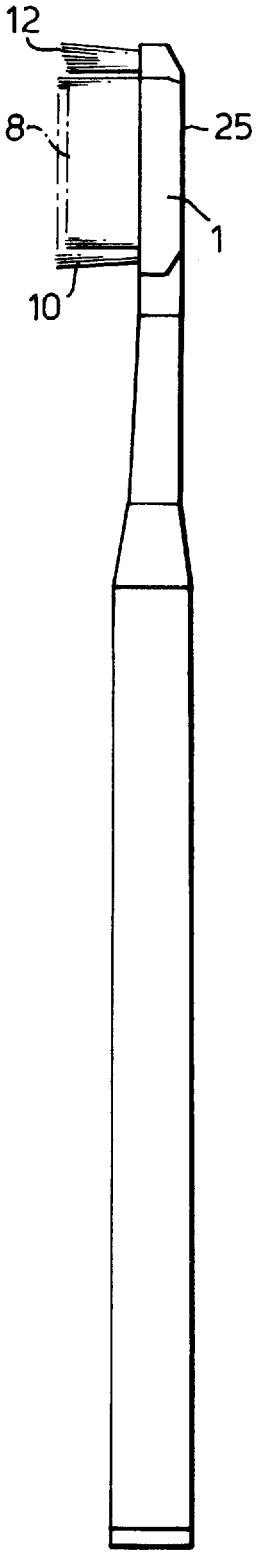
FIG. 2 is a side elevation of the toothbrush of FIG. 1.

FIGS. 1 to 9 show a first embodiment of a toothbrush of the invention. FIG. 1 shows a top plan view of the toothbrush of the invention while FIG. 2 shows a side elevational view of the toothbrush.

As shown in FIGS. 1 and 2, the toothbrush is made up of a head (1) and a handle (2).

FIG. 3 shows a top plan view of the toothbrush head of FIGS. 1 and 2 while FIG. 4 shows a side elevation of the toothbrush head.

Figure 6:
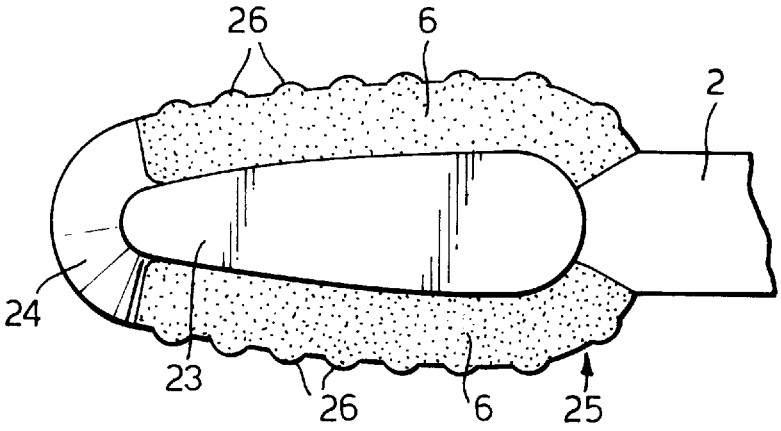
FIG. 6 is a bottom plan view of the toothbrush head of FIG. 1.

FIG. 5 shows a longitudinal cross-section through the toothbrush head along the line V—V of FIG. 3 while FIG. 6 shows an underneath plan view of the toothbrush head.

As shown in the drawings, the head (1) is mounted or internally moulded at one end of the handle (2) and is made up of an undercarriage-type skeleton (3) in which a resilient head block (25) (shown shaded) is disposed. The skeleton (3) has a narrow elongate ellipsoidal portion (23) which is a continuation of the handle (2). At the end remote from the handle (2), the skeleton (3) is expanded laterally outwards to define a semi-circular tip portion (24) in head tip (21). The semi-circular tip portion is most clearly illustrated in FIG. 6.

The head block (25) is supported by the ellipsoidal portion (23) and the semi-circular tip portion (24). The head block (25) extends laterally outwards from i.e. stands proud of the ellipsoidal portion (23) and extends upwards from the ellipsoidal portion (23) to define two resilient side members (6). Therefore, the resilient side members (6) are not directly mounted on the skeleton (3) and hence have greater flexibility than the portion of the head block (25) which is mounted on the skeleton (3).

The under carriage-type skeleton (3) increases the surface area of the head to facilitate bonding of the side members (6) to the head (1). The head block (25), when viewed from a top plan view as shown in FIG. 3, entirely covers the toothbrush head. However, when viewed from the side as shown in FIG. 4 and from underneath as shown in FIG. 6, the under carriage nature of the skeleton (3) is more clearly visible and clearly shows that the under carriage portion partially surrounds the head block (25).

The head (1) is provided with a centre array of bristles (8) made up of substantially tear or pear-shaped bristle tufts (9) when viewed from above and two side arrays (10) either side of the centre array (8) made up of linear bristle tufts (11) disposed substantially perpendicular to the longitudinal axis of the handle (2). The semi-circular tip (24) is further provided with a tip array (12) of bristles having a substantially frustoconical outline when viewed from above as shown in FIG. 3.

The side array of bristles (10) are provided with boots (7) which extend upwards from the head block (25) and are moulded from the same resilient material. The linear tufts of the side arrays (10) are supported by the boots (7) and are restrained within the boot (7) by a bond between the resilient material of the head block (25) and the material of the bristles of the linear tufts (11).

The linear tufts (11) are made up of bristle filaments which can flex and splay outwards from the centre array (8) in use. Fine bristle filaments which can also be used enhance the splaying effect. The flexibility of the linear tufts (11) is further enhanced by the manner in which the resilient side members (6) stand proud of the under carriage skeleton (3).

However, due to the resilience of the side members (6) and of the boots (7), the linear tufts (11) return to their original positions following use and do not exhibit excessive splaying.

The toothbrush of the invention can be assembled using standard technology known as anchor bar technology combined with moulding. For instance, the bristles or filaments can be attached to the head using said anchor bar technology combined with moulding. More particularly, the bristles or filaments can be attached to the head using said anchor bar technology and the resilient head block (25) moulded around the bristles.

Figure 7:
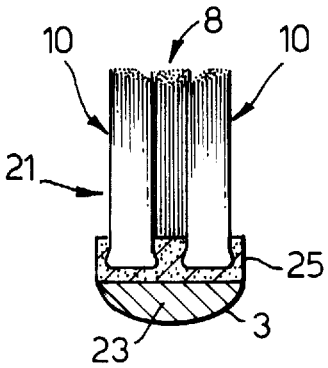
FIG. 7 is a cross sectional view along the line VII—VII of FIG. 3.
Figure 8:
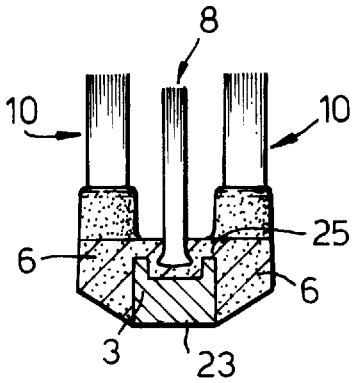
FIG. 8 is a cross sectional view along the line VIII—VIII of FIG. 3.
Figure 9:
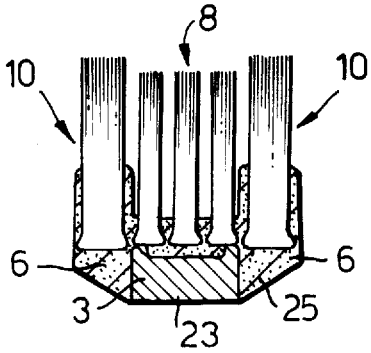
FIG. 9 is a cross-sectional view along the line IX—IX of FIG. 3.

FIGS. 7 to 9 show cross-sectional views along the lines VII—VII, VIII—VIII, IX—IX respectively of FIG. 3 and illustrated varying longitudinal dimensions of the ellipsoidal portion (23) of the under carriage skeleton (3). As shown in the drawings, the skeleton (3) is partially surrounded by the head block (25) while the skeleton (3) varies in thickness along the length of the ellipsoidal portion (23) to increase the surface area of the head (1) to facilitate bonding of the side members (6) and to vary the degree of flexibility of the brush head along its length without the need to utilise segments or spaces in the toothbrush head.

Similarly, the thickness of the head block (25) surrounding the skeleton (23) is varied to provide varying degrees of flexibility in the toothbrush head.

The boots (7) of the side arrays (10) also stand slightly proud of the side walls of the side members (6) to provide an uneven surface on the periphery of the toothbrush head. The uneven or undulating periphery of the toothbrush head formed by the resilient material of the boots (7) can therefore be utilised to provide a massaging effect to the teeth and/or gums in use.

Figure 10:
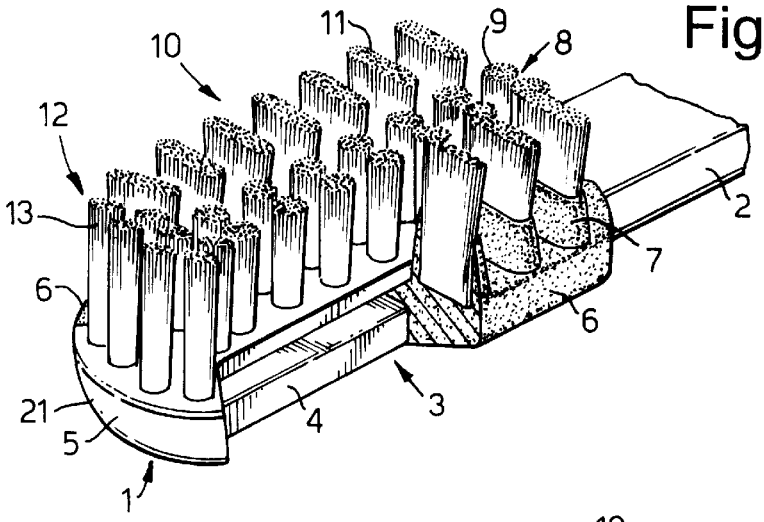
FIG. 10 is a perspective view of a second embodiment of a toothbrush head of the invention with the head partially cut away.

FIG. 10 is a perspective view of a second embodiment of a toothbrush of the invention. The toothbrush is made up of the head (1) mounted at one end of the elongated handle (2). The head (1) is moulded in the form of a skeleton (3) mounted below a head body (5). The skeleton (3) has two side wings (4) which extend laterally outwards from the head body (5). The skeleton (3) increases the surface area of the head (1) to facilitate bonding of the side members (6) to the head.

The two resilient side members (6) are mounted or moulded onto the side wings (4). The side members (6) terminate at the rounded head tip (21) formed by the head body (5).

The head (1) is provided with a centre array of bristles (8) made up of circular bristle tufts (9), and two side arrays (10) either side of the centre array (8) made up of linear bristle tufts (11) similar to those previously described. The head tip (21) is provided with a tip array (12) of bristles made up of circular tip tufts (13).

The resilient side members (6) adhere to the wings (4) and are provided with upwardly extending boots (7) to support the side arrays of bristle tufts (10). The linear tufts of the side arrays (10) are mounted in the boots (7) and are restrained within the boots (7) by the bond between the resilient material of the side members (6) and the material of the bristles of the linear tufts (11).

The linear tufts (11) are made up of fine bristles which can flex or toggle in a multidirectional fashion and splay outwards from the centre array (8) in use. However, due to the resilience of the side members (6), the linear tufts (11) return to their original positions following use and do not exhibit excessive splaying i.e. the tufts exhibit a memory effect due to the use of resilient materials.

Figure 11:
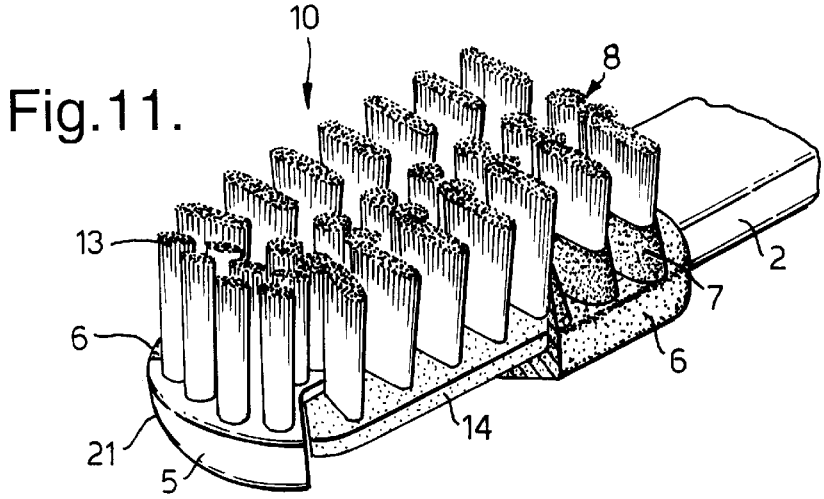
FIG. 11 is a perspective view of a third embodiment of a toothbrush head of the invention with the head partially cut away.

FIG. 11 shows a perspective view of an alternative embodiment of the invention in which the wing (4) of the skeleton (3) is replaced by a weblike substrate (14). In the present embodiment the bases of the individual tufts are melted or moulded together to form the web-like substrate (14). Therefore, the web-like substrate (14) is made up of the actual bristle material. The weblike substrate (14) is manufactured from a material such as nylon in which the linear tufts (11) are directly melted during manufacture of the brush. The resilient side members (6) are mounted or moulded over the weblike substrate (14) and individual linear tufts and chemically bonded in the region of the boots (7) to the bristles and the web-like substrate (14) and to the body of the head (1) to provide a support as described in the embodiment of FIG. 10.

Figure 12:
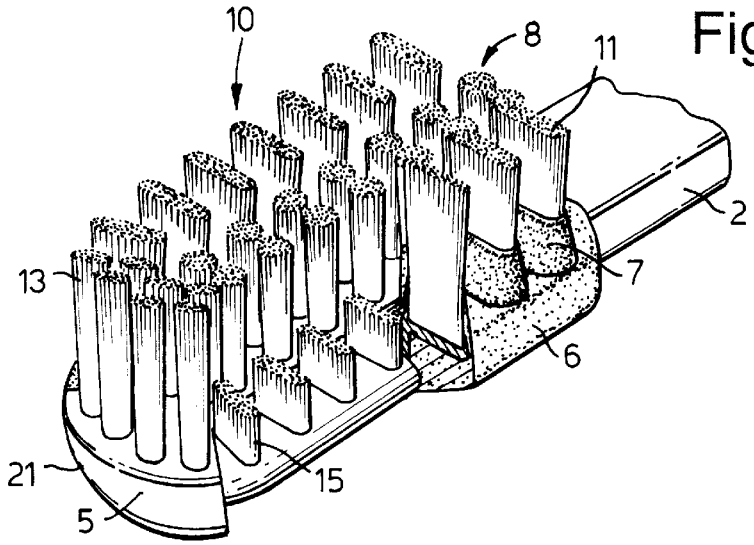
FIG. 12 is a perspective view of a fourth embodiment of a toothbrush head of the invention with the head partially cut away.

FIG. 12 shows a perspective view of yet an alternative embodiment of the invention in which the wing (4) of the skeleton is provided with upwardly extending inner boots (15). The thin walled inner boots (15) being part of the head moulding (1) are made of a rigid material which is less resilient than the material of the standard boots (7) also present on the side members (6). The linear tufts (11) are mounted in the inner boots (15) to provide tuft retention and additional support for the bristles and prevent excessive splaying during toggling.

Figure 13:
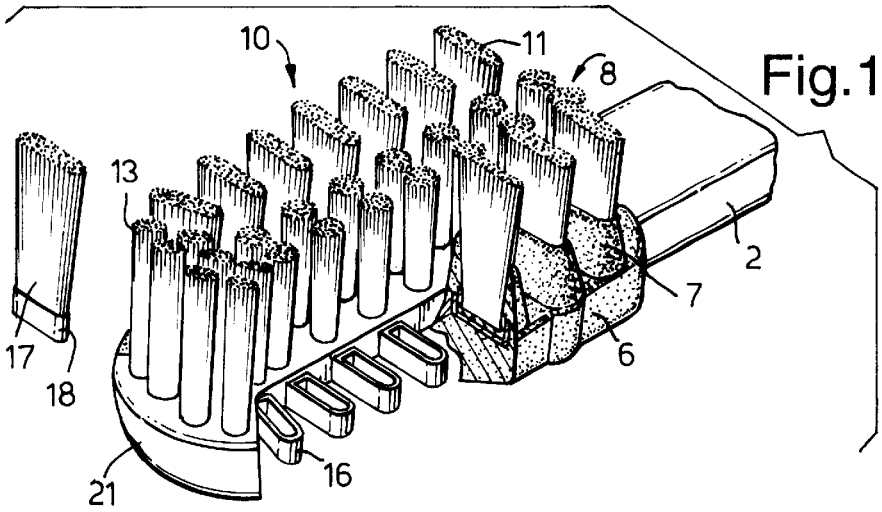
FIG. 13 is a perspective view of a fifth embodiment of a toothbrush head of the invention with the head partially cut away and a bottom sleeve removed for clarity.

FIG. 13 shows a perspective view of yet another alternative embodiment of the invention similar to that shown in FIG. 10 but in which the wing (4) of the skeleton (3) is replaced by an array of wells (16) in which the linear tufts (11) are mounted or captured. In the present embodiment, the linear tufts (11) can be prefabricated to be easily inserted in the wells (16).

The array of wells (16) is encased in the resilient side member material (6). The resilient side members (6) are also provided with boots (7) as previously described which support the linear bristle tufts (11) also as previously described.

The linear tufts (11) are formed individually to provide the prefabricated tuft (17). The bristles of the prefabricated tuft (17) are held together by a separate bottom sleeve (18), or by melting the individual bristles together in a controlled fashion.

Figure 14:
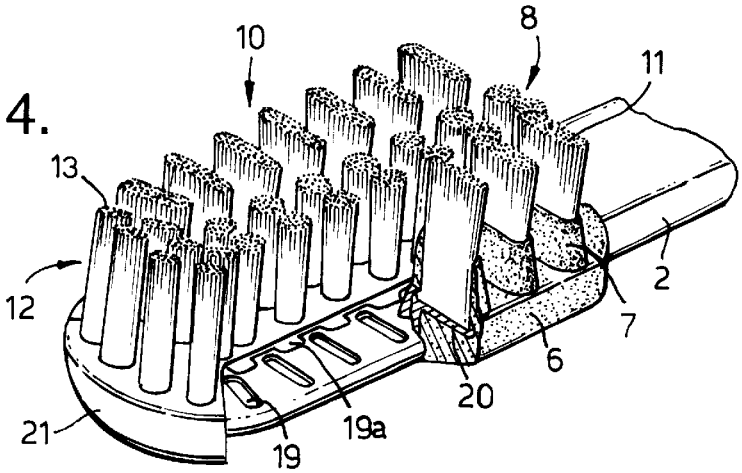
FIG. 14 is a perspective view of a sixth embodiment of a toothbrush head of the invention with the head partially cut away.

FIG. 14 shows a perspective view of a further embodiment of a toothbrush of the invention similar to that shown in FIG. 10 but in which the wing (4) of the skeleton (3) is provided with holes (19) in which the linear tufts (11) are mounted or captured. The holes (19) define roots (20) for the linear tufts to support the tufts in position. The wing (4) is covered with resilient side member material (6) as previously described. Interspaced holes (19*a*) impart flexibility to the wing (4) to further improve the flexibility and splaying effect of the linear tufts (11).

The centre array (8) and the tip array (12) of bristle tufts can be mounted on the toothbrush according to methods known in the art e.g. stapling, gluing, or in-mould welding.

FIGS. 15 to 25 show alternative arrangements of the centre, side and tip arrays (8), (10) and (12) respectively of the toothbrush head (1), the arrays being formed on the brush head according to the methods described above. The arrangement of the bristles in conjunction with the side members (6) provides an efficient toggling and hence cleaning effect due to the orientation of the surfaces defined by the free ends of the tufts.

Figure 15:
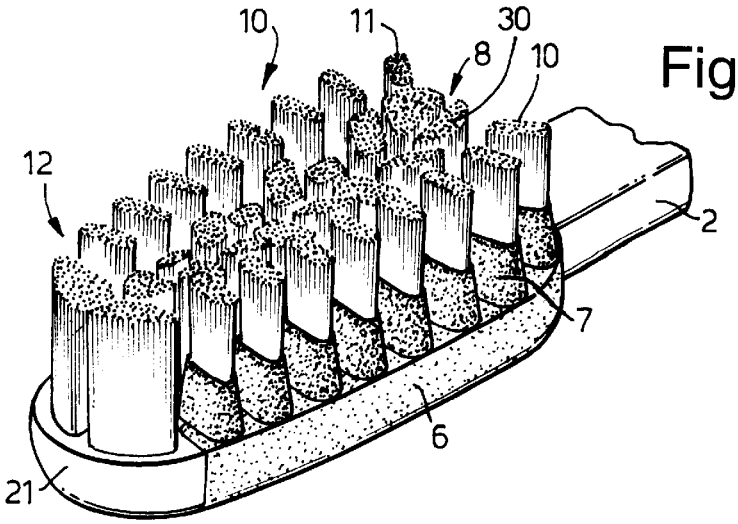
FIG. 15 is a perspective view of a toothbrush head of the invention similar to that shown in FIG. 10 but having an alternative arrangement of bristle tufts with the handle partially cut away.

FIG. 15 shows a perspective view of an alternative toothbrush head of the invention similar to the embodiment shown in FIG. 10 but with an alternative bristle array.

More particularly, the side arrays (10) are made up of linear tufts (11) as previously described which are supported by boots (7) while the tip array (12) is made up of tufts having a substantially frustoconical outline when viewed from above.

The centre array (8) is made up of tufts (9) of bristles cut or shaped so as to define a series of tufts (9) whose free ends are cut/shaped to define alternating surfaces at their free ends to enhance the cleaning effect on the teeth. As shown in FIG. 15, the tufts (9) of bristles define top surfaces (30) of the tufts (9) which slope downwards towards the plane defined by the handle (2) in an alternating fashion.

Figure 16:
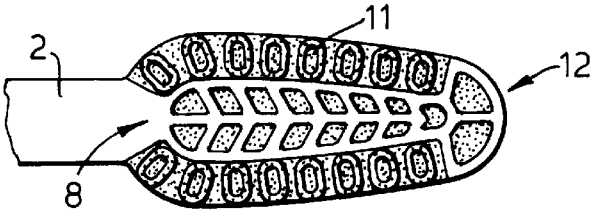
FIG. 16 is a top plan view of the toothbrush of FIG. 15.

FIG. 16 shows a top plan view of the toothbrush head of FIG. 15.

Figure 17:
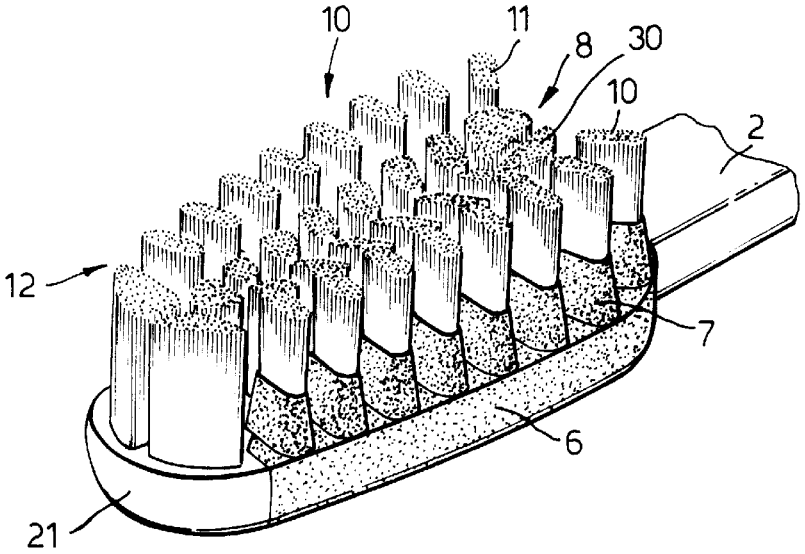
FIG. 17 is a perspective of a toothbrush head of the invention similar to that shown in FIG. 10 but having a further alternative tuft arrangement.

FIG. 17 shows a perspective view of an alternative arrangement of arrays (8, 10 and 12). The head is made up similarly to the embodiment shown in FIG. 10 while the centre array (8) have sloped top surfaces (30) of bristles similar to those described in FIG. 15 which do not alternate. More particularly, the surfaces (30) are sloped inwards towards the centre of the brush head.

FIG. 18 again shows a toothbrush similar to the embodiment described in FIG. 10 but with an alternative bristle arrangement. More particularly, the tip array (12) is provided with semi-circular tufts (31) which follow the outline of the toothbrush tip (21). The side arrays (10) are similar to the side arrays previously described while the centre array (8) is made up of a series of tufts (9) having sloped top surfaces (30). The tufts (9) of bristles in the centre array (8) are substantially linear similar to the array of the side arrays (10) but in which the top surfaces (30) have been shaped/cut to define sloped surfaces.

Figure 18:
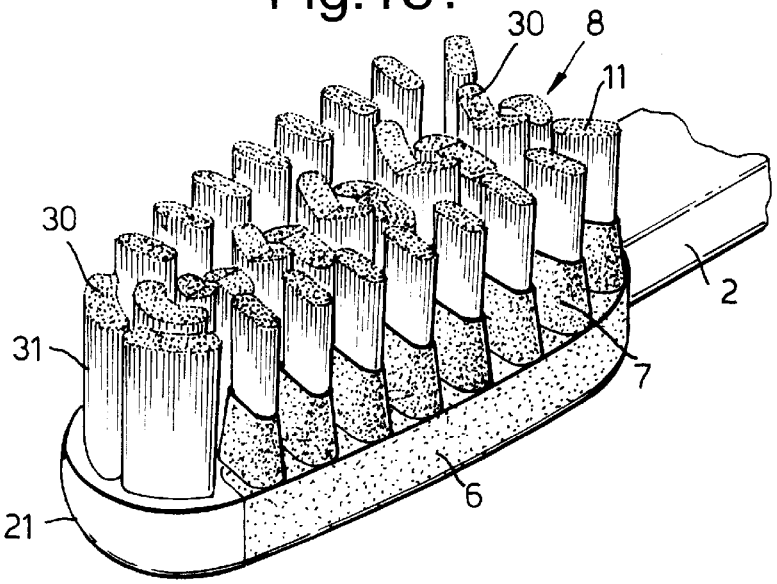
FIG. 18 is a perspective view of a toothbrush head of the invention similar to that shown in FIG. 10 but having another bristle tuft arrangement.
Figure 19:
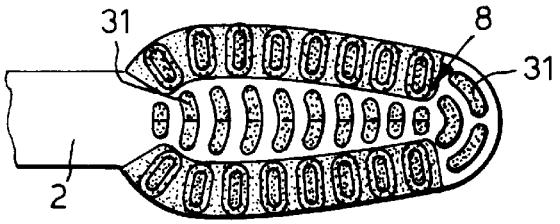
FIG. 19 is a top plan view of the toothbrush of FIG. 21.

FIG. 19 is a top plan view of the configuration of FIG. 18 and shows the semi-circular tip tufts (31). As shown in FIG. 19, the centre array (8) of tufts (9) is also made up of tufts which are slightly semi-circular in shape.

Figure 20:
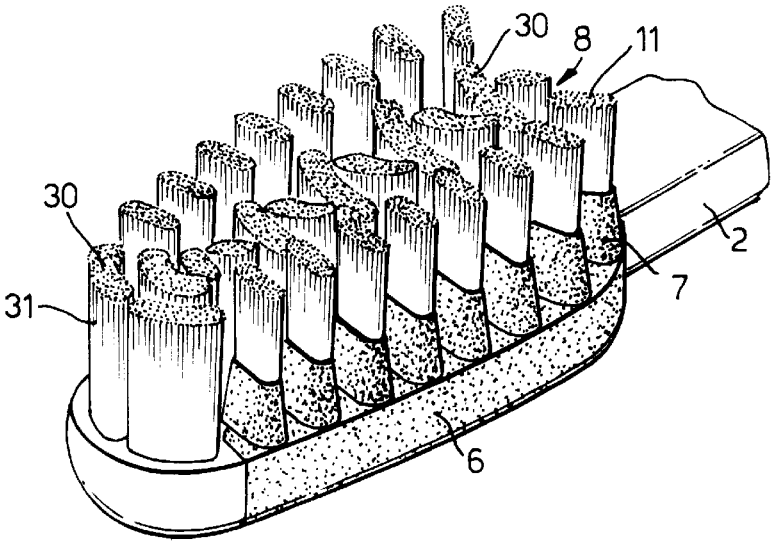
FIG. 20 is a perspective view of a toothbrush head of the invention again similar to that shown in FIG. 10, but with a further bristle tuft arrangement.

FIG. 20 shows a perspective view of yet another arrangement of array in which the centre array of bristles is again a linear tuft (9) but with the surfaces (30) of the tufts sloping in a curved fashion but in alternate directions.

Figure 21:
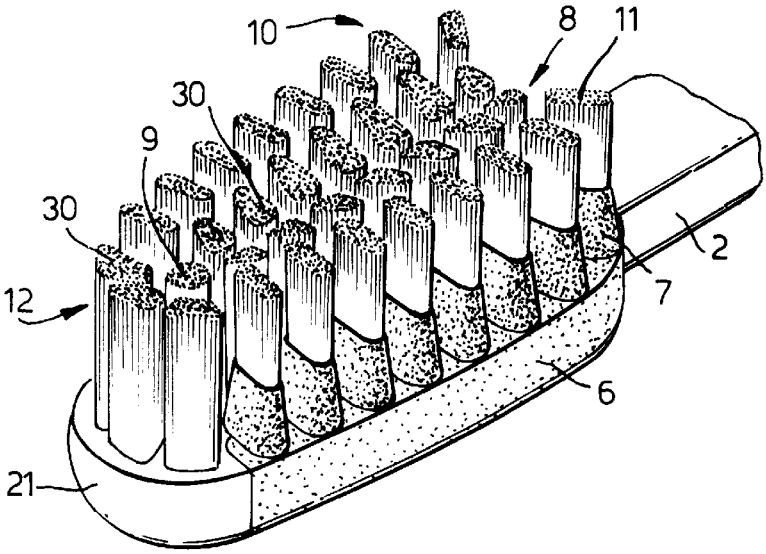
FIG. 21 is a perspective view of a toothbrush head of the invention similar to that shown in FIG. 10 but with yet a further alternative bristle tuft arrangement.

FIG. 21 shows a perspective view of a toothbrush head again similar to the embodiment shown in FIG. 10 but with yet a further arrangement of centre side and tip arrays (8, 10 and 12) respectively in which the top surfaces of the centre array (8) are sloped inwards towards the central longitudinal axis of the handle (2) while the tip tufts (12) are radially sloped inward towards the centre of the circular head tip (21) and is provided with a circular tuft (9) of bristles between the tip tuft (12) and the centre array (8).

Figure 22:
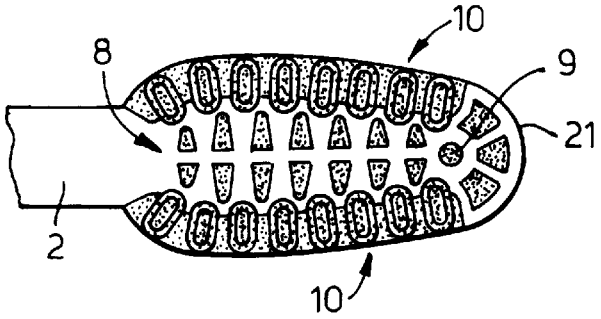
FIG. 22 is a top plan view of the toothbrush of FIG. 21.

FIG. 22 more clearly illustrates the circular tip tuft described in relation to FIG. 21.

Figure 23:
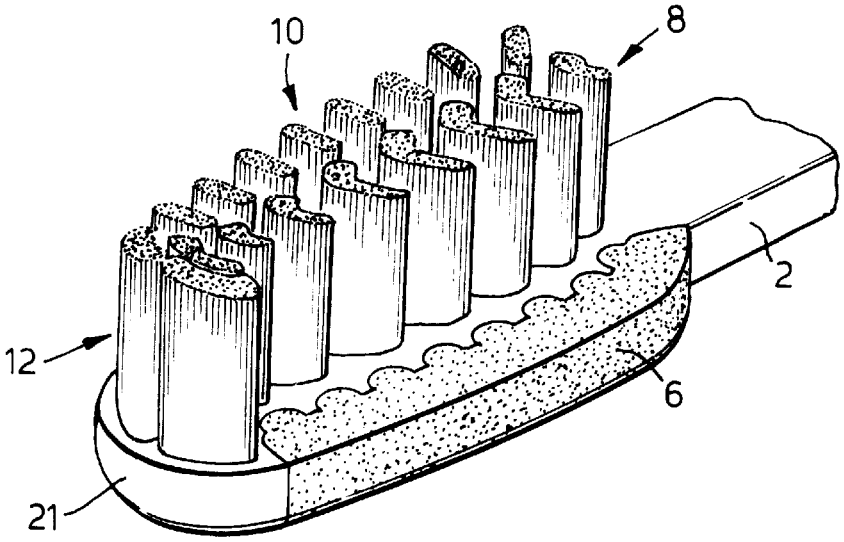
FIG. 23 is a perspective view of a toothbrush head of the invention similar to that shown in FIG. 10 but with another bristle tuft array and with a portion of the peripheral array omitted for clarity.
Figure 24:
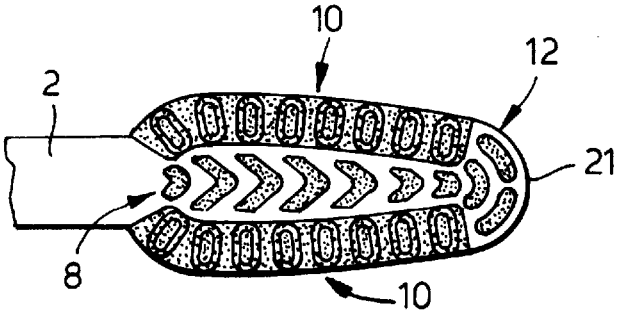
FIG. 24 is a top plan view of the toothbrush of FIG. 23.

FIG. 23 shows a perspective view of a toothbrush head of the invention similar to that shown in FIG. 10 but with another bristle tuft arrangement and with a portion of the peripheral array omitted to more clearly illustrate the centre array (8). The head (1) of this embodiment is moulded in the form of a skeleton (3) as previously described. The interface between the head (1) and the resilient side members (6) is interlocking to increase the surface area of the head (1) to facilitate bonding to the side members (6). The centre array (8) is made up of substantially V-shaped tufts when viewed from above as shown in FIG. 24.

Figure 25:
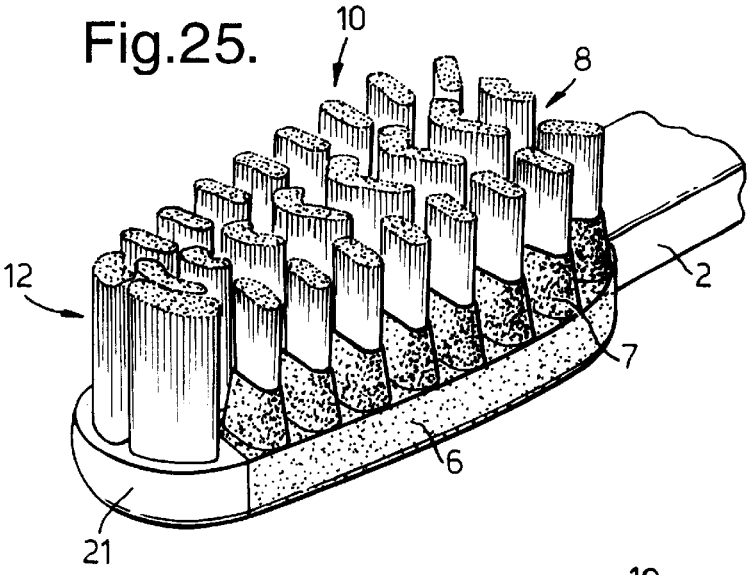
FIG. 25 is a perspective view of the toothbrush head of FIG. 23 with the peripheral array of bristles in place.

FIG. 25 shows a perspective view of the toothbrush head of FIG. 23 in which the complete array of bristles is shown.

Figure 26:
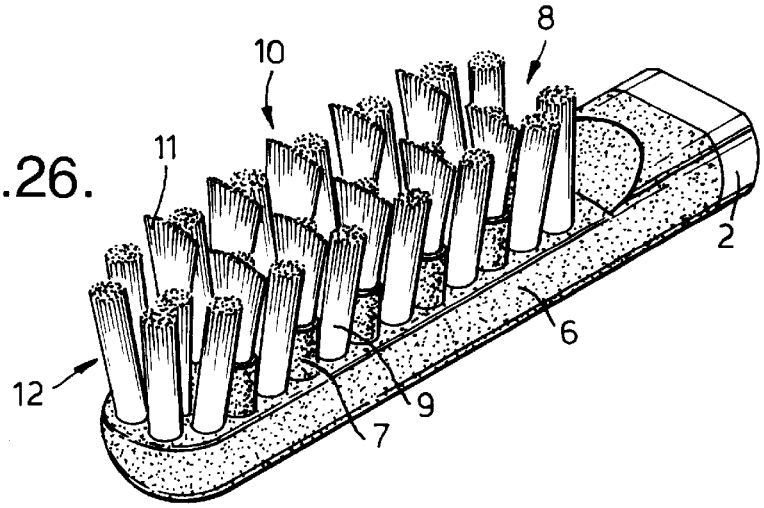
FIG. 26 is a perspective view of an alternative embodiment of a toothbrush head of the invention having booted peripheral bristle tufts and unbooted tufts in a rubber encased head.

FIG. 26 shows an alternative embodiment of the invention in which the head (1) is entirely encased in resilient material such that the skeleton (3) as described in FIG. 10 is not visible. The side arrays (10) are made up of circular tufts (9) of bristles. The circular tufts (9) are alternated with tufts of fine fanned linear tufts (11) and thicker circular tufts. The fine linear tufts of bristles (9) are provided with boots (7) to support the bristles as previously described.

Figure 27:
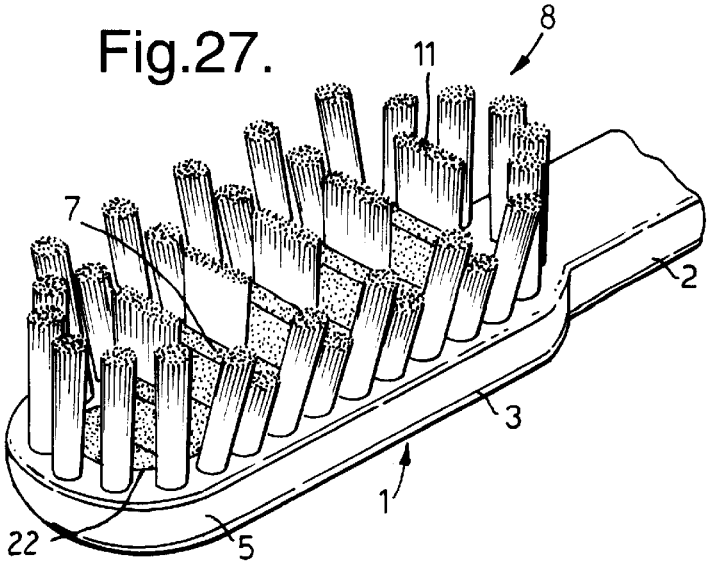
FIG. 27 is a perspective view of yet another embodiment of a toothbrush head of the invention having a booted centre array of bristles.

FIG. 27 shows an alternative embodiment of the toothbrush of the invention in which the centre array (8) of bristles is made up of linear tufts (11). The centre array of bristles (8) is embedded in a central island (22) of flexible resilient material such as rubber. The linear tufts (11) of the centre array (8) are provided with boots (7) as previously described. The bristles of the centre array (8) can be made up of coarse or fine bristles as described above. Accordingly, the centre array (8) is made up of splayable bristles which can toggle in a multidirectional manner while the outer side arrays (10) are mounted in a frame similar to bristle tufts of the prior art.

Figure 28:
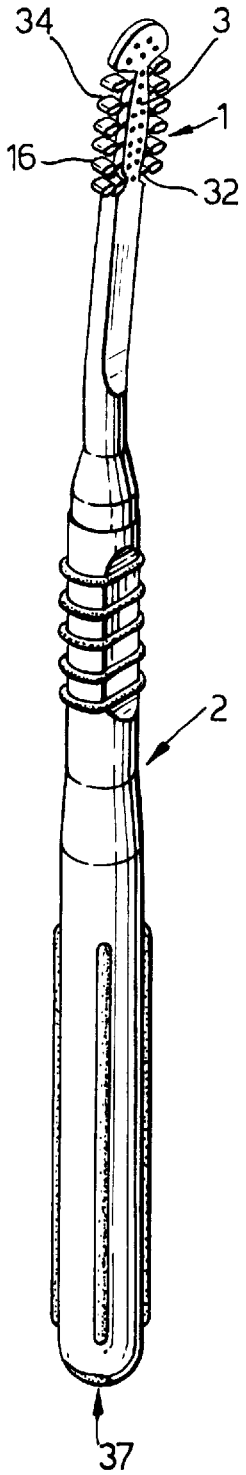
FIG. 28 is a perspective view of a further embodiment of a toothbrush of the invention with the skeleton encased in resilient material.
Figure 29:
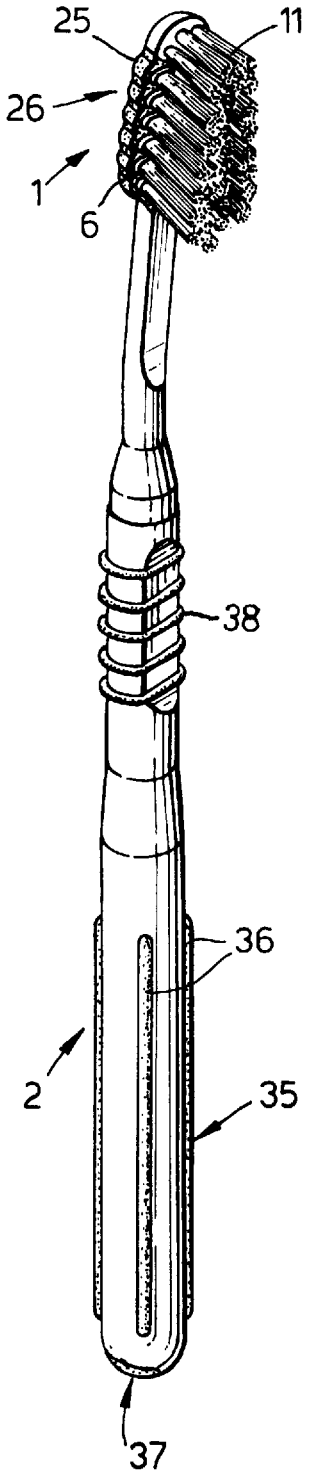
FIG. 29 is a perspective view of the toothbrush of FIG. 28 with the skeleton removed.

FIG. 28 and 29 show perspective views of a further embodiment of a toothbrush of the invention. As shown the toothbrush is provided with a head (1) and a handle (2) as previously described.

The toothbrush head (1) is a hybrid of the embodiments shown in FIGS. 13 and 14. The head (1) is made up of an array of wells (16) flexibly attached either side of the skeleton (3). Bristle tufts are mounted in openings in the central skeleton and in the well (16), the central skeleton being sufficiently thick or wide to accommodate tufts. However, in the present embodiment the wells (16) are attached to the skeleton (3) by flexible bridges (32). The bridges (32) are formed from the same material as the skeleton (3). The bridges (32) define hinges or pivot points about which the wells (16) can oscillate or flex in a multidirectional manner i.e. "toggle". The bridges (32) are sufficiently thin to facilitate toggling.

Bristle tufts (11) are moulded into the wells (16) as previously described. The wells (16) are spaced apart by gaps (34) similar to the holes (33) previously described in relation to FIG. 14. The gaps (34) facilitate the flexing/splaying or toggling of the wells (16) along the brush head (1).

The degree of movement or toggling of the bristle tufts (11) within the wells (16) can also be adjusted by altering the location or position of the bridges (32) in relation to the wells (16) and the skeleton (3).

For example the location of the bridges or hinges (32) along the vertical axis defined by the well-depth dictates the degree of well articulation. In addition, the position of the bridges (32) in relation to the skeleton (3) can also dictate the degree of toggling. Well flexing can also be varied by altering the bridge thickness as previously described while the outer faces or walls of the skeleton (3) can also be profiled to alter the range of movements of the hinges or bridges (32).

In summary, the hinge is preferably as thin and as long as possible to ensure maximum flexibility when surrounded by the resilient material. However, the exact dimensions are in part dictated by the freezing of the hard plastics material of the skeleton when injected during manufacture.

A preferred minimum hinge diameter obtainable whilst maintaining flow is 0.3 mm ×0.3 mm for a hinge length of 0.5 mm and rectangular cross-section.

Flexibility and movement is increased with a hinge at least 1 mm long and diameter greater than 0.3 mm ×0.3 mm e.g. 0.5 mm (depth) by 0.7 mm (width). It has been found that the hinge width can be increased more than the depth as it has a lower impact on the flexibility.

The flexibility of the hinge can be further enhanced, and the manufacturing process improved by using a polypropylene material with a high flow index (MFI). An flow index (MFI) of at least 25 and suitably greater than 50 is particularly desirable.

The array of wells (16) is encased in a head block (25) which defines the resilient side member material (6), while the wells (16) remain visible from below the brush head (1).

The wells (16) are surrounded by the resilient side member material (6) to define undulating/massaging surfaces (26). The massaging surfaces (26) impart a desirable massaging effect to a user's gums, mouth and teeth in use.

The handle (2) of the present embodiment is also provided with resilient material. More particularly, the handle (2) is provided with a gripping portion (35) remote from the head (1). The gripping portion is provided with four longitudinal gripping bars (36) parallel to the longitudinal axis defined by the brush handle (2). The gripping bars (36) are made up the resilient material and protrude from the surface of the gripping portion (35) to facilitate a user's grip in use.

The gripping portion (35) is provided with an end grip (37) at the handle (2) tip remote from the brush head (1). The end grip (37) is also manufactured from the resilient material and typically enhances grip of the brush in the palm region in use.

The handle (2) of the brush has five thumb grips (38) intermediate the brush head (1) and the gripping bars (36). The thumb grips (38) are also manufactured from the resilient material and protrude from the handle (2) surface and extend transverse to the longitudinal axis defined by the handle (2).

The abovementioned features of the invention namely the flexible side members (6) and/or the use of fine bristles together with boots (7) provides a self-adjusting toggling tuft design to deliver effective brushing.

The side linear tufts (11) of the side array (10) are supported by the flexible boots (7). Generally, the bristle tufts of the side arrays (10) can be 50% narrower than conventional bristle tufts such that the bristles will spread or splay with ease as they meet resistance against teeth in use. Such automatic fanning of the bristles facilitates deeper gum line and interproximal penetration without the high forces and discomfort that are experienced with traditional geometries. The flexible rubber boots reinforce the bristles to offset the relative softness of the bristles to provide a resilient memory which preserves the tuft shape.

The mounting of the tufts of bristles together with the boots (7) on the side member (6) allow individual tufts (9) to independently flex and adjust to the irregular dental topography.

Therefore, the combination of flexing of the boots (7) and the side member (6) lowers the point at which the tufts bend to the head thereby creating a longer lever arm that results in a toggle effect that ensures that bristles remain in crevices longer for superior plaque removal. Accordingly, the bristles can adjust in all directions to ensure continuous bristle contact in the complex architecture of the teeth and gums.

The alternating surfaces and shapes of the centre array of bristles (8) facilitate the removal of plaque from the triangular spaces between adjoining teeth and broad tooth surfaces. The alternating surfaces and the tear drop shaped tufts as shown in FIG. 3 for example provide each tuft with two cleaning actions that work simultaneously and deliver a dynamic action when downward force and horizontal pressure is applied to the brush head. The narrow long side of the array (8) deeply penetrates the spaces between the teeth while the wide short side of the tear drop shape or pear shape offers increased stiffness maximising the cleaning contact with the tooth. The individual movement potential of the tufts facilitate contact by the individual tufts to multiple tooth surfaces without being pushed away or structurally supported by adjacent tufts.

The tip tufts (12) are suitably made of dense tufts of bristles which are configured radially at the tip (21) of the brush and are comparably more narrow than the other tuft groups on the brush head. The tapered nature of the ellipsoidal shaped brush head allows for increased rear molar access. Moreover, the elastomeric rubber tip as shown in FIG. 3 and the elastomeric wings of side member (6) of the brush head act as a soft bumper to increase comfort while accessing tight often ignored areas of the mouth. The radially sloped trim of the tip tufts provide superior reach and bristle tips maximising plaque removal on the back sides of rear molars.

An advantage of the toothbrushes of the invention is that the use of separably moveable tufts on the outer edge of the brush head having soft flexible rubber holders containing fine filaments facilitates access to previously inaccessible areas of the tooth.

The arrangement ensures that the bristles are surface sensitive in that each tuft of bristle moves independently in an upward/downward direction, responding to the changing contour of teeth. This enables the toothbrush bristles to penetrate and remove plaque from difficult to reach places in which plaque bacteria are to be found.

The use of top surfaces of bristles at different angles further improves the cleaning performance as the teeth are therefore scrubbed from different angles.

The bristle filaments can be manufactured from standard bristle materials such as nylon and polyester and can be coextruded. A single brush can have filaments manufactured from a combination of such materials.

The head (1) of the toothbrush of the invention can also be detachable from the handle to provide a toothbrush having interchangeable heads.

COMPARATIVE DATA

A toothbrush of the invention having a toggling movement was compared with a standard toothbrush in clinical trials to compare plaque removal ability.

Subjects were requested not to brush their teeth for 48 hours. Plaque on the facial and lingual surfaces of all the teeth, excluding the third molars and central incisors, was disclosed and assessed using the Turesky (1970) modification of the Quigley and Hein Plaque Index. The plaque index is defined as follows:

Plaque Index (Turesky et al, 1970)

This index is weighted towards plaque present in the proximal sites and along the gingival margin. Plaque is disclosed on the buccal and lingual surfaces with 0.5% erythrosine. The plaque is scored on a numerical scale according to the following criteria:

0 - Absence of plaque

1 - separate flecks of plaque at the gingival margin

2 - A thin continuous band of plaque (up to 1 mm) at the gingival margin

3 - A band wider than 1 mm but covering less than one-third of the surface

4 - Plaque covering at least one-third but less than two-thirds of the surface

5 - Plaque covering more than two-thirds of the surface

Each tooth is scored in six areas: a) mesio-facial, b) mid-facial, c) disto-facial, d) mesio-lingual, e) mid-lingual, f) disto-lingual.

A total score of 30 is possible.

Forty four subjects then brushed for 60 seconds with their assigned brush: 30 seconds in one maxillary quadrant and 30 seconds in the contra-lateral mandibular quadrant. The process was then repeated with the second brush in the opposing quadrants.

Allocation of brushes and toothbrushing were supervised in a separate room from the examiner. After rinsing with water the remaining plaque was redisclosed and rescored. Data was recorded by a scribe.

The data was analysed using the paired t-tests, with the UNIVARIATE procedure within the Base module of SAS. The statistical significance of product differences was assessed for each variable of interest.

RESULTS

The baseline values were well balanced for both brushes for the dentition overall and also for the sub groups which were analysed.

The data from all forty four subjects was included in the analysis. The effect of the plaque removal ability of the brushes was compared in six areas and shown to be highly significant for all teeth and surfaces combined, anterior teeth and interproximal surfaces.

TABLE 1

All teeth and surfaces (mean and standard deviation)

| Brush type | Before brushing | After brushing | mean diff | % change |
|---|---|---|---|---|
| Invention | 2.46 (0.38) | 0.69 (0.30) | 1.76 (0.36) | 72 |
| Prior Art | 2.46 (0.33) | 0.86 (0.37) | 1.59 (0.43) | 65 |

Significance value of effect between brushes $p < 0.0017$

TABLE 2

Anterior teeth (mean and standard deviation)

| Brush type | Before brushing | After brushing | mean diff | % change |
|---|---|---|---|---|
| Invention | 2.27 (0.44) | 0.66 (0.44) | 1.62 (0.41) | 72 |
| Prior Art | 2.26 (0.41) | 0.80 (0.46) | 1.45 (0.51) | 64 |

Significance value of effect between brushes $p < 0.0080$

TABLE 3

Interproximal surfaces (mean and standard deviation)

| Brush type | Before brushing | After brushing | mean diff | % change |
|---|---|---|---|---|
| Invention | 2.51 (0.38) | 0.81 (0.30) | 1.71 (0.35) | 68 |
| Prior Art | 2.52 (0.33) | 0.99 (0.39) | 1.53 (0.43) | 61 |

Significance value of effect between brushes $p < 0.0006$

TABLE 4

Premolars (mean and standard deviation)

| Brush type | Before brushing | After brushing | mean diff | % change |
|---|---|---|---|---|
| Invention | 2.34 (0.47) | 0.65 (0.35) | 1.68 (0.45) | 72 |
| Prior Art | 2.36 (0.41) | 0.82 (0.44) | 1.54 (0.56) | 65 |

Significance value of effect between brushes $p < 0.0586$

TABLE 5

Molars (mean and standard deviation)

| Brush type | Before brushing | After brushing | mean diff | % change |
|---|---|---|---|---|
| Invention | 2.75 (0.43) | 0.79 (0.33) | 1.95 (0.45) | 71 |
| Prior Art | 2.75 (0.38) | 0.96 (0.42) | 1.79 (0.47) | 65 |

Significance value of effect between brushes $p < 0.0378$

The effect of the brushes in respect to the whole mouth is shown in Table 1 above. The brush of the invention removed 7% more plaque than the brush of the prior art which was significant at $p<0.0017$. The data was examined further to determine the effect of the brushes on different tooth types within the dentition. When considering the anterior, premolar and molar teeth separately the same result was obtained with the brush of the present invention removing 6%, 7% and 6% more plaque than the brush of the prior art. Significance values for these three groups were $p<0.0080$,0.0586 and 0.0378 respectively.(Tables 2,4 and 5)

The interproximal sites for the whole mouth were considered separately and again the brush of the invention removed more plaque than the brush of the prior art, the result being significant at $p<0.0006$. (Table 3).

CONCLUSIONS

The brush of the invention was significantly more effective than the prior art brush at removing plaque from all teeth and surfaces particularly the anterior teeth and interproximal surfaces. The tests demonstrated improved plaque removal efficacy for a flexibly mounted tufted toothbrush having a toggling movement as compared with a brush having no toggling movement.

Therefore, the toggling movement allows flexibility and deflection of the tufts of bristles such that those not under pressure by the teeth have greater penetration of the areas between the teeth resulting in enhanced plaque removal.

We claim:

1. A toothbrush comprising a handle and a bristle bearing head, the head comprising a central skeleton with sides flanking the skeleton, a resilient side member mounted on each side of the central skeleton, a plurality of tuft mounting receptacles in the skeleton and in the side members, a plurality of bristles forming tufts received in the tuft mounting receptacles of the skeleton and in the side members, the side member bristle tufts being resiliently movable sideways and downwards in a toggling movement relative to the bristle tufts of the skeleton.

2. A toothbrush as claimed in claim 1 wherein the skeleton comprises a material having a modulus of elasticity which is higher than a modulus of elasticity of the resilient side members.

3. A toothbrush as claimed in claim 1 wherein the side member tuft mounting receptacles comprise an array of rigid wells attached to the skeleton.

4. A toothbrush as claimed in claim 3 wherein the wells are substantially surrounded by the respective resilient side member.

5. A toothbrush as claimed in claim 4 wherein the side member tuft mounting receptacles further comprise a bridge hinge intermediate the respective well and the skeleton.

6. A toothbrush as claimed in claim 5 wherein each bridge hinge comprises a material having a flow index of at least 25.

7. A toothbrush as claimed in claim 1 wherein the skeleton is ellipsoidal.

8. A toothbrush as claimed in claim 1 wherein the skeleton is substantially surrounded by the side members.

9. A toothbrush as claim in claim 1 wherein the side members further comprise at least one massaging protrusion.

10. A toothbrush as claim in claim 1 wherein the resilient side members further comprise at least one resilient boot surrounding at least one of the bristle tufts.

11. A toothbrush as claimed in claim 10 wherein each resilient side member and the associated at least one boot is integral to form a unitary resilient member.

12. A toothbrush as claimed in claim 11 wherein the resilient side members and the at least one boot associated therewith comprise a rubber material.

13. A toothbrush as claimed in claim 1 wherein the central skeleton further comprises a frame which surrounds the resilient side members.

14. A toothbrush as claimed in claim 1 wherein the tufts of bristles comprise tear-shaped tufts.

15. A toothbrush as claimed in claim 1 wherein the skeleton comprises a material selected from the group consisting of polypropylene and nylon.

16. A toothbrush as claimed in claim 1 wherein the side member bristle tufts comprise fine bristles.

* * * * *